US010054083B2

(12) United States Patent
Selway et al.

(10) Patent No.: US 10,054,083 B2
(45) Date of Patent: Aug. 21, 2018

(54) INTERNAL COMBUSTION ENGINE HAVING SIX CYLINDERS WITH TWO OF THE CYLINDERS BEING DEDICATED EGR CYLINDERS CONTROLLED WITH DUAL EGR VALVE

(71) Applicants: Martin Selway, Steyning (GB); Ian Paul Gilbert, Shoreham-by-Sea (GB); Marc C. Megel, La Vernia, TX (US)

(72) Inventors: Martin Selway, Steyning (GB); Ian Paul Gilbert, Shoreham-by-Sea (GB); Marc C. Megel, La Vernia, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 141 days.

(21) Appl. No.: 14/755,058

(22) Filed: Jun. 30, 2015

(65) Prior Publication Data

US 2017/0002774 A1 Jan. 5, 2017

(51) Int. Cl.

| | |
|---|---|
| ***F02M 26/41*** | (2016.01) |
| ***F02M 26/16*** | (2016.01) |
| ***F02M 26/42*** | (2016.01) |
| ***F02M 26/53*** | (2016.01) |
| ***F02M 26/55*** | (2016.01) |
| ***F02M 26/70*** | (2016.01) |
| ***F02M 26/05*** | (2016.01) |
| ***F02M 26/19*** | (2016.01) |
| ***F02M 26/28*** | (2016.01) |
| ***F02M 26/43*** | (2016.01) |

(52) U.S. Cl.

CPC ..... *F02M 26/41* (2016.02); *F02M 26/05* (2016.02); *F02M 26/16* (2016.02); *F02M 26/19* (2016.02); *F02M 26/28* (2016.02); *F02M 26/42* (2016.02); *F02M 26/43* (2016.02); *F02M 26/53* (2016.02); *F02M 26/55* (2016.02); *F02M 26/70* (2016.02)

(58) Field of Classification Search

CPC ..... F02M 26/05; F02M 26/16; F02M 26/19; F02M 26/23; F02M 26/38; F02M 26/39; F02M 26/41; F02M 26/42; F02M 26/43; F02M 26/44; F02M 26/53; F02M 26/54; F02M 26/70; F02M 26/71

USPC ..... 123/568.11, 568.12, 568.2, 568.21; 60/605.2

See application file for complete search history.

(56) References Cited

U.S. PATENT DOCUMENTS

| | | | | |
|---|---|---|---|---|
| 6,381,960 | B1 * | 5/2002 | Mardberg | F02B 37/025 60/602 |
| 6,484,500 | B1 * | 11/2002 | Coleman | F02B 37/004 123/568.11 |
| 7,168,250 | B2 * | 1/2007 | Wei | F02B 37/013 123/568.12 |
| 7,987,837 | B2 * | 8/2011 | Lupescu | F01N 3/0835 123/568.2 |

(Continued)

FOREIGN PATENT DOCUMENTS

| | | | | |
|---|---|---|---|---|
| DE | 102004015108 | A1 * | 10/2005 | F02B 37/007 |
| DE | 102013201710 | A1 * | 8/2014 | F02B 47/08 |
| JP | 2008075741 | A * | 4/2008 | F16K 1/221 |

*Primary Examiner* — John Zaleskas

(74) *Attorney, Agent, or Firm* — Livingston Law Firm

(57) ABSTRACT

An exhaust gas recirculation (EGR) system for an internal combustion engine having two dedicated EGR cylinders. A dual valve system is used to control the output of the dedicated EGR cylinders so that the engine may intake EGR exhaust from both, only one, or neither of the dedicated EGR cylinders.

19 Claims, 5 Drawing Sheets

(56) References Cited

U.S. PATENT DOCUMENTS

| | | | | |
|---|---|---|---|---|
| 2006/0021347 | A1* | 2/2006 | Sun | F02B 37/013 60/612 |
| 2010/0024416 | A1* | 2/2010 | Gladden | F02B 37/001 60/605.2 |
| 2010/0154416 | A1* | 6/2010 | Bruce | F01N 13/10 60/605.2 |
| 2010/0211292 | A1* | 8/2010 | Geyer | F02M 26/39 701/108 |
| 2010/0292910 | A1* | 11/2010 | Gibble | F02D 41/0065 701/103 |
| 2011/0000470 | A1* | 1/2011 | Roth | F02D 13/0249 123/568.11 |
| 2012/0000448 | A1* | 1/2012 | Freund | F02M 26/43 123/568.21 |
| 2012/0260897 | A1* | 10/2012 | Hayman | F02D 41/005 123/568.2 |
| 2013/0000614 | A1* | 1/2013 | Freund | F02D 21/08 123/568.2 |
| 2013/0283766 | A1* | 10/2013 | Primus | F02D 41/0065 60/274 |
| 2013/0306041 | A1* | 11/2013 | Koga | F02M 25/07 123/568.11 |

* cited by examiner

INTERNAL COMBUSTION ENGINE HAVING SIX CYLINDERS WITH TWO OF THE CYLINDERS BEING DEDICATED EGR CYLINDERS CONTROLLED WITH DUAL EGR VALVE

TECHNICAL FIELD OF THE INVENTION

This invention relates to internal combustion engines, and more particularly to such engines having one or more cylinders dedicated to production of recirculated exhaust.

BACKGROUND OF THE INVENTION

In an internal combustion engine system having dedicated EGR (exhaust gas recirculation), one or more cylinders of the engine are segregated and dedicated to operate in a rich combustion mode. As a result of the rich combustion, the exhaust gases from the dedicated cylinder(s) include increased levels of hydrogen and carbon monoxide. Rich combustion products such as these are often termed "syngas" or "reformate".

Dedicated EGR engines use the reformate produced by the dedicated cylinder(s) in an exhaust gas recirculation (EGR) system. The hydrogen-rich reformate is ingested into the engine for subsequent combustion by the non-dedicated cylinders and optionally by the dedicated cylinder(s). The reformate is effective in increasing knock resistance and improving dilution tolerance and burn rate. This allows a higher compression ratio to be used with higher rates of EGR and reduced ignition energy, leading to higher efficiency and reduced fuel consumption.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to various systems and methods for a dedicated EGR system installed in a vehicle, such as an automobile, that also has an exhaust aftertreatment system. The dedicated EGR system of this invention has two dedicated EGR cylinders. A dual valve system controls the EGR exhaust flow so that the two dedicated EGR cylinders can be controlled to provide an EGR rate of 33%, 17% or 0% to the engine intake.

Conventional Dedicated EGR System (Prior Art)

Figure 1:
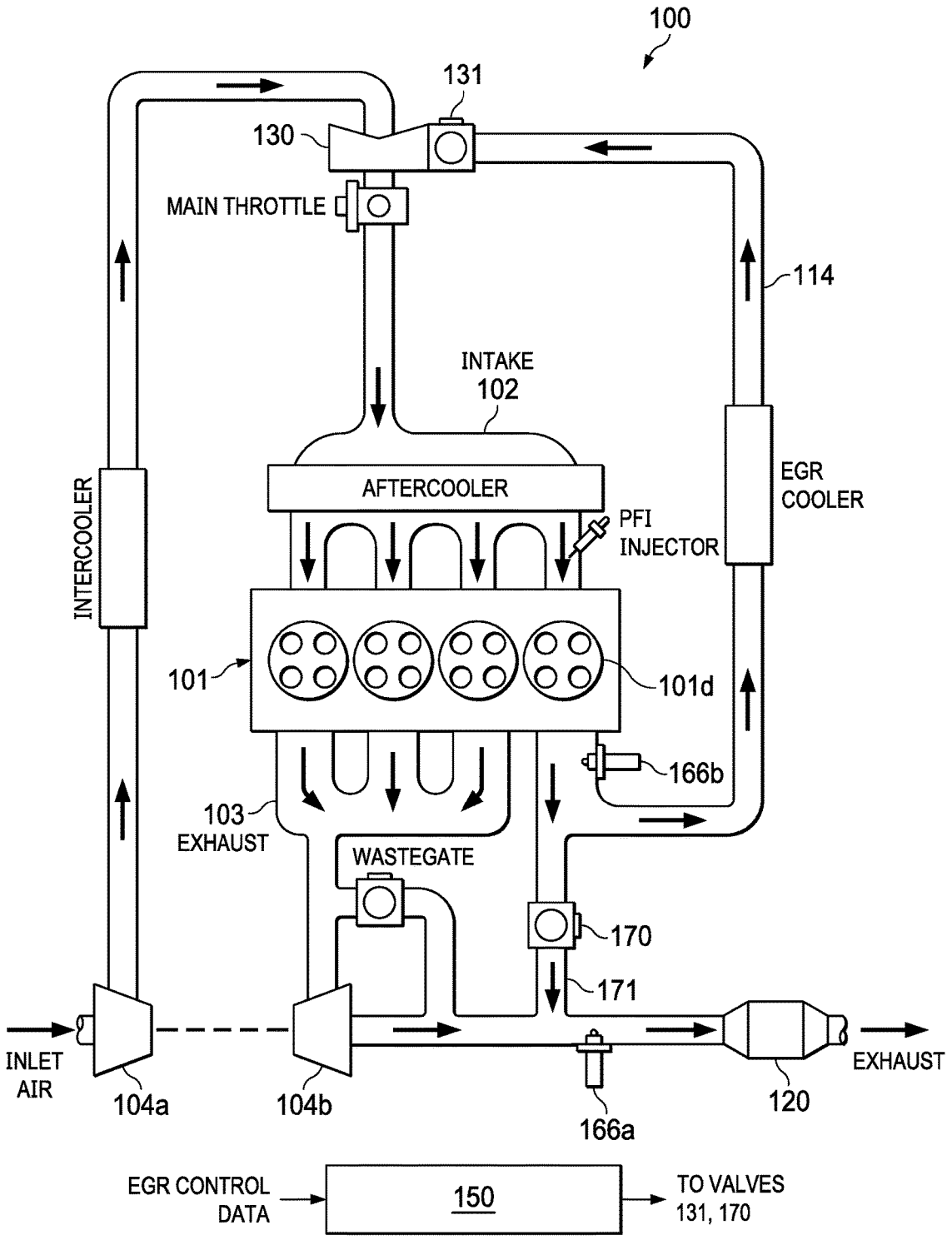
FIG. 1 (PRIOR ART)
FIG. 1 illustrates a four cylinder engine with one dedicated EGR cylinder.

FIG. 1 illustrates an internal combustion engine 100 having four cylinders 101. One of the cylinders is a dedicated EGR cylinder, and is identified as cylinder 101*d*. In the example of FIG. 1, engine 100 is gasoline-fueled and spark-ignited, with each cylinder 101 having an associated spark plug.

The dedicated EGR cylinder 101*d* may be operated at any desired air-fuel ratio. All of its exhaust is recirculated back to the intake manifold 102.

In the embodiment of FIG. 1, the other three cylinders 101 (referred to herein as the "main" or "non dedicated" cylinders) are operated at a stoichiometric air-fuel ratio. Their exhaust is directed to an exhaust aftertreatment system via an exhaust manifold 103.

Engine 100 is equipped with a turbocharger, specifically a compressor 104*a* and a turbine 104*b*. Although not explicitly shown, the cylinders 101 have some sort of fuel delivery system for introducing fuel into the cylinders. This main fuel delivery system can be fumigated, port injected, or direct injected.

In the example of this description, the EGR loop 114 joins the intake line downstream the compressor 104*a*. A mixer 130 mixes the fresh air intake with the EGR gas. A throttle 105 is used to control the amount of intake (fresh air and EGR) into the intake manifold 102.

An EGR valve 131 may be used to control the EGR intake into the intake manifold 102. Alternatively, other means, such as variable valve timing, may be used to control EGR flow.

In other dedicated EGR systems, there may be a different number of engine cylinders 101, and/or there may be more than one dedicated EGR cylinder 101*d*. In general, in a dedicated EGR engine configuration, the exhaust of a subgroup of cylinders can be routed back to the intake of all the cylinders, thereby providing EGR for all cylinders. In some embodiments, the EGR may be routed to only the main cylinders.

After entering the cylinders 101, the fresh-air/EGR mixture is ignited and combusts. After combustion, exhaust gas from each cylinder 101 flows through its exhaust port and into exhaust manifold 103. From the exhaust manifold 103, exhaust gas then flows through turbine 104*b*, which drives compressor 104*a*. After turbine 104*b*, exhaust gas flows out to a main exhaust line 119 to a three-way catalyst 120, to be treated before exiting to the atmosphere.

As stated above, the dedicated EGR cylinder 101*d* can operate at any equivalence ratio because its exhaust will not exit the engine before passing through a non-dedicated EGR cylinder 101 operating at a stoichiometric air-fuel ratio. Because only stoichiometric exhaust leaves the engine, the exhaust aftertreatment device 120 may be a three-way catalyst.

To control the air-fuel ratio, exhaust gas may be sampled by an exhaust gas oxygen (EGO) sensor. Both the main exhaust line 122 and the EGR loop 114 may have a sensor (identified as 166*a* and 166*b*), particularly because the dedicated EGR cylinder may be operated at a different air-fuel ratio than non-dedicated cylinders.

If a dedicated EGR cylinder is run rich of stoichiometric A/F ratio, a significant amount of hydrogen (H2) and carbon monoxide (CO) may be formed. In many engine control strategies, this enhanced EGR is used to increase EGR tolerance by increasing burn rates, increasing the dilution limits of the mixture and reducing quench distances. In addition, the engine may perform better at knock limited conditions, such as improving low speed peak torque results, due to increased EGR tolerance and the knock resistance provided by hydrogen (H2) and carbon monoxide (CO).

The four-cylinder dedicated EGR system 100 works well with a single dedicated cylinder, giving a 25% EGR rate. For engine start and low load/temperature operation, a bypass valve 170 and bypass line 171 may be used to reduce the EGR rate. If EGR exhaust gas is bypassed to the main exhaust line instead of to the EGR loop, the dedicated EGR cylinder may be made to run stoichiometric during the bypass period, so that the three-way catalyst aftertreatment system will remain effective.

An EGR control unit 150 has appropriate hardware (processing and memory devices) and programming for controlling the EGR system. It receives data from the sensors described above, and performs various EGR control algorithms. It then generates control signals to the various valves and other actuators of the EGR system.

Figure 2:
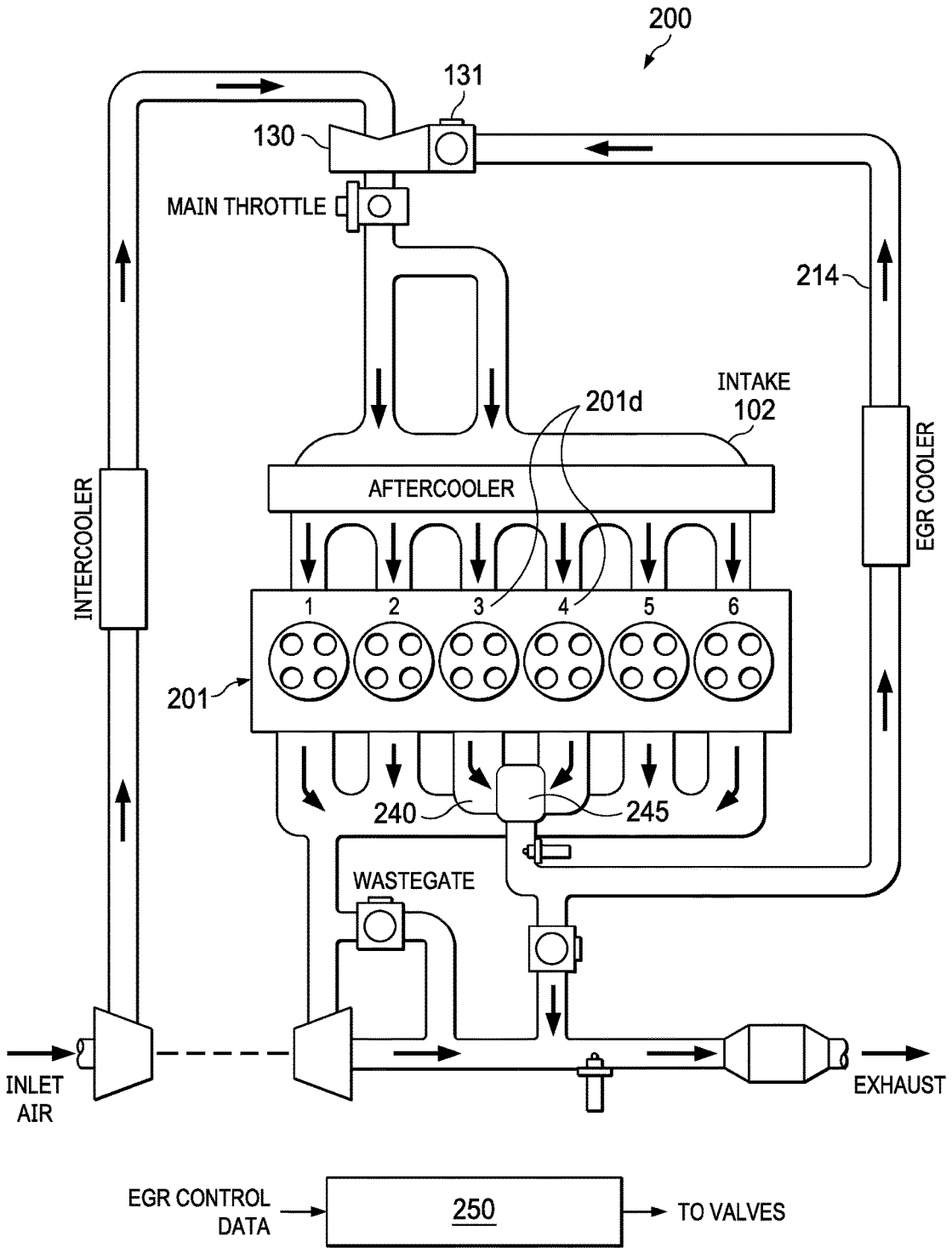
FIG. 2 illustrates a six cylinder engine with two dedicated EGR cylinders and a dual valve system in accordance with the invention.

Dedicated EGR System with Four Main Cylinders, Two Dedicated EGR Cylinders, and Dual EGR Valve System FIG. 2 illustrates an EGR system 200 configured with a total of six cylinders 201. Four of the cylinders are main cylinders 201; two of the cylinders are dedicated EGR cylinders 201*d*. The dedicated EGR cylinders 201*d* are the middle two cylinders of an in-line cylinder layout. For purposes of identification herein, the main cylinders 201 may be referred to as Cylinders 1, 2, 5 and 6. The dedicated EGR cylinders 201*d* may be referred to as Cylinders 3 and 4.

Although details are not explicitly shown in FIG. 2, and are more fully described below, EGR system 200 also has a dual valve system 245 that allows adjustment of the EGR rate. This dual valve system 245 switches the EGR flow from 2, 1 or 0 paths into the EGR loop. The dual valve system 245 receives EGR exhaust from a short exhaust manifold 240 that has two separate ports into the EGR valve system 245, one for each dedicated EGR cylinder 201*d*. The dual valve system 245 delivers EGR exhaust to either the main exhaust line (via bypass line 271) or to the EGR loop 214.

Other than having two dedicated EGR cylinders 201*d* rather than one, and having dual valve system 245, engine 200 has the same basic elements as, and operates similarly to, the four-cylinder engine described above.

As stated above, a four-cylinder engine with one dedicated EGR cylinder allows a 25% EGR rate. For engines with different numbers of cylinders, different rates of EGR are possible. For example, a six-cylinder engine with one dedicated EGR cylinder can have a 17% EGR rate, and with two dedicated EGR cylinders it can have a 33% EGR rate. However, it has been shown that 17% EGR may not give the same benefits as 25% EGR. On the other hand, 33% EGR may be too high to sustain reliable combustion at certain operating conditions, such as at light loads and low speeds. It would therefore be beneficial to be able to switch between different EGR rates during engine operation.

Figure 3:
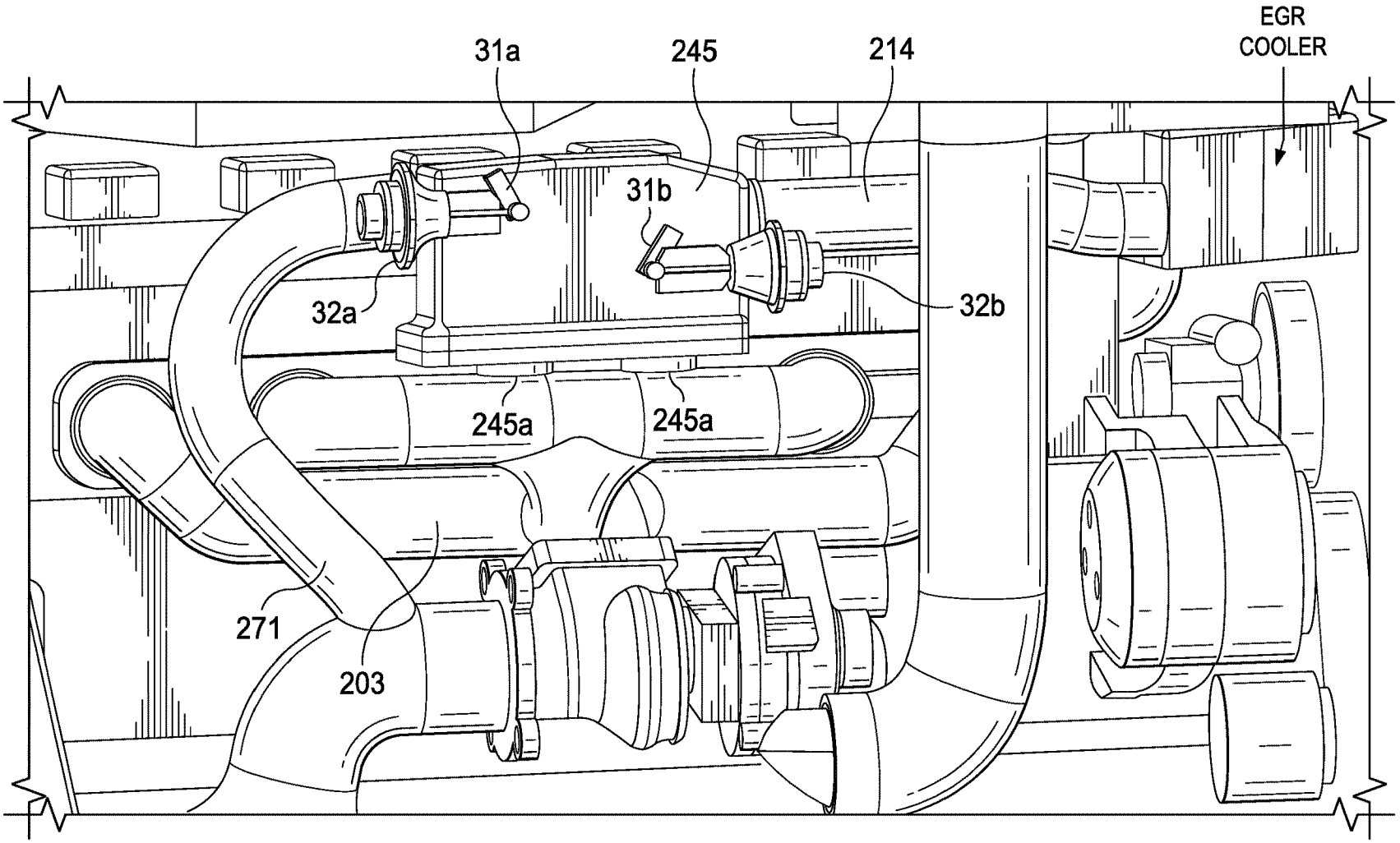
FIG. 3 illustrates the dual valve system in further detail.

FIG. 3 illustrates dual valve system 245 in further detail, as well as its connections to other engine components, its location, and its relative size in the engine bay. In the embodiment of FIG. 3, dual valve system 245 is housed in a small housing, which contains valves 31*a* and 31*b*.

As explained below, each valve 31*a* and 31*b* is associated with exhaust input from one of the dedicated EGR cylinders 210*d*. Specifically, valve 31*a* is associated with dedicated EGR Cylinder 4 and valve 31*b* is associated with dedicated EGR Cylinder 3.

From valve system 245, EGR may exit into EGR loop 214 or into the main exhaust line 219. In the example of this description, where the EGR system has a by-pass line 271, the connection to the main exhaust line is via this by-pass line 271.

As discussed in further detail below, each valve 31*a* and 31*b* has an associated actuator 32*a* and 32*b*. In the embodiment described herein, each valve is a "flap" type valve. The flap pivots to close one output opening and open the other. Thus, the actuation for each valve is two-position, that is, either open or closed. Each valve selects one of two possible paths for EGR exhaust flow.

Figure 4:
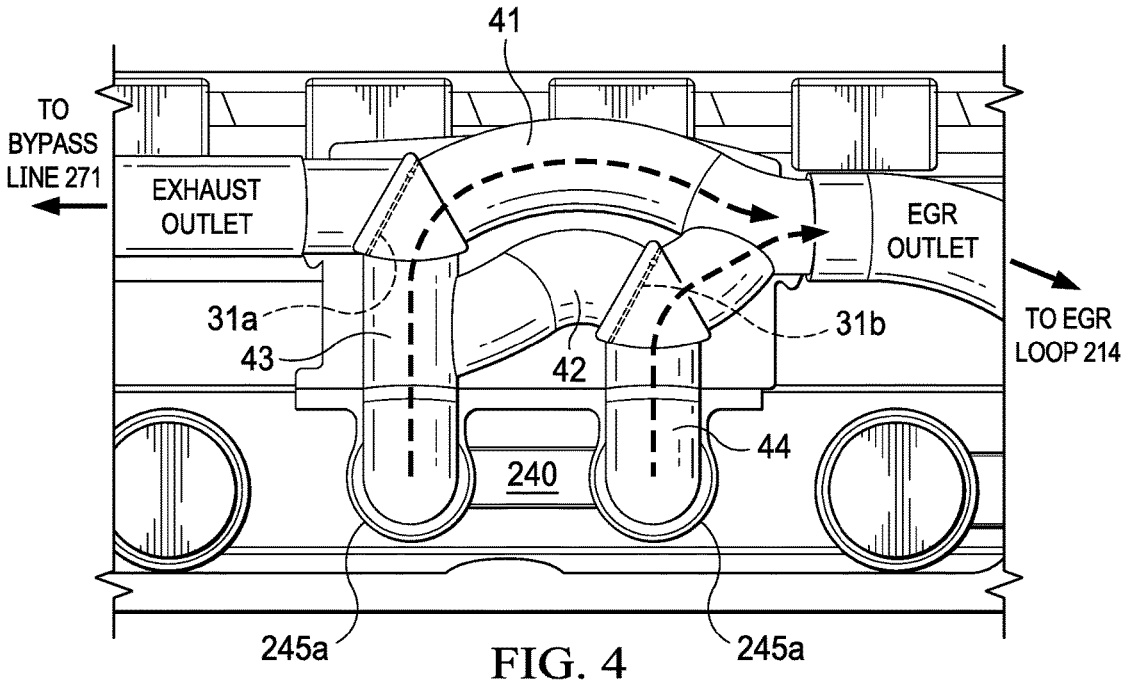
FIG. 4 illustrates the dual valve system set for a 33% EGR rate.
Figure 5:
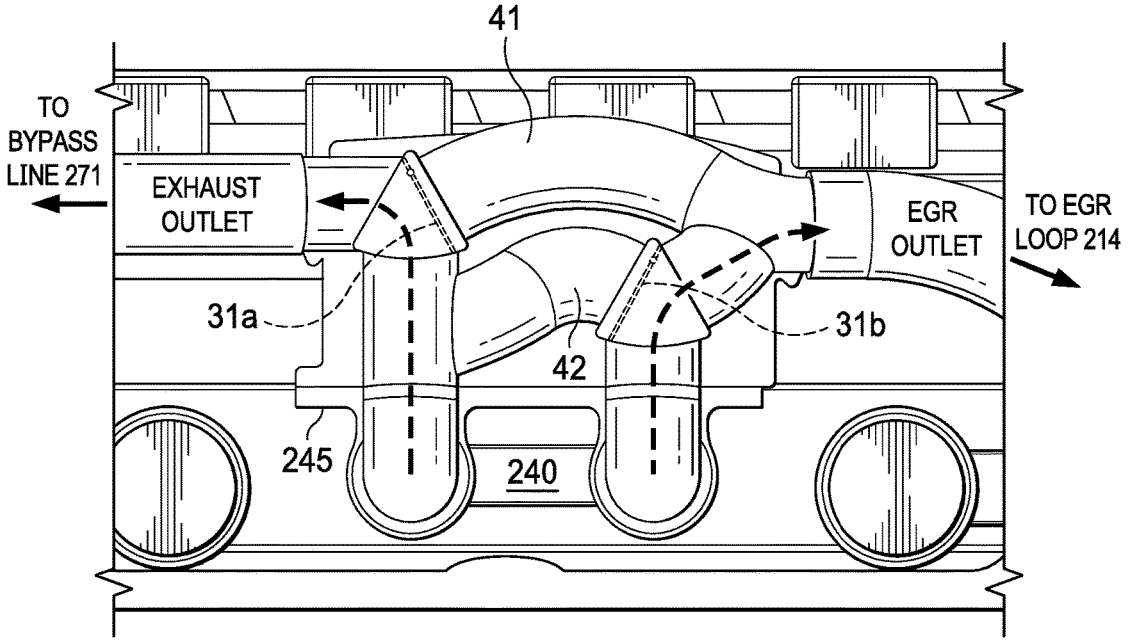
FIG. 5 illustrates the dual valve system set for a 17% EGR rate.
Figure 6:
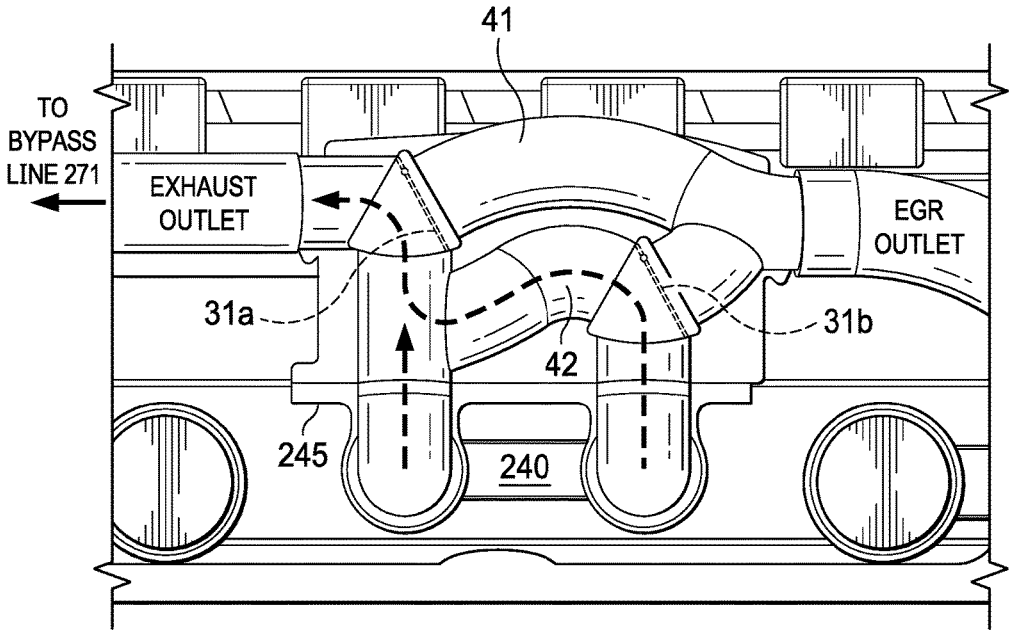
FIG. 6 illustrates the dual valve system set for a 0% EGR rate.

FIGS. 4-6 are cross sectional views of valve system 245. These figures show valves 31*a* and 31*b* in three possible operating states.

As illustrated, EGR manifold 240 (or other output structure from the dedicated EGR cylinders) provides separate inputs for each dedicated EGR cylinder 201*d* into valve system 245. Thus, the housing for valve system 245 has two EGR input ports 245*a*.

Each EGR input goes to a valve 31*a* or 31*b* via an EGR input connection line 43 or 44, respectively. Depending on the positions of the valves, internal cross-flow lines 41 and 42 are used to direct EGR flow from each dedicated EGR cylinder (Cylinders 3 and 4) to either the EGR loop 214 or to bypass line 271.

Valves 31*a* and 31*b* are each single-input/dual-output valves. Hence, they are a type of three-way valve, but more specifically, are used to select fluid flow from a single input to one of two outputs. Thus, valves 31*a* and 31*b* may be more specifically referred to as "selector" or "two-position" three-way valves.

As stated above, valves 31*a* and 31*b* operate by opening and closing flaps, which either allow or block fluid flow. Other three-way valve mechanisms, known in the art of fluid flow valves, are possible. Examples are rotary and spool valves.

An example of an actuator 32*a* or 32*b* for this type of valve is a vacuum actuator. The vacuum source could be the intake manifold depression or an electrically or mechanically driven vacuum pump. In many automotive systems, a vacuum source is already available for providing assistance to the vehicle brakes or for powering other vacuum actuators. Electrically driven solenoid valves are used to control the flow of vacuum from the vacuum source to the vacuum actuator. In other embodiments, various electric actuators could be used. Furthermore, as explained below in connection with FIG. 7, in other embodiments, actuators 32*a* and 32*b* could be replaced with a single actuator that drives both valves 31*a* and 31*b*.

FIG. 4 illustrates valve system 245 set to route EGR exhaust from both dedicated EGR cylinders 201*d* (Cylinders 3 and 4) into the EGR loop 214. This results in an EGR rate of 33% (33⅓% rounded). The flaps of both valves 31*a* and 31*b* are set to the left, such that exhaust from each dedicated EGR cylinder is presented with a relatively unrestricted route through valve system 245. This results in a minimum of pressure loss.

FIG. 5 illustrates valve system 245 set to route EGR exhaust gas from Cylinder 3 to EGR loop 214 and EGR exhaust gas from Cylinder 4 to the main exhaust line (via by-pass line 271). This results in an EGR rate of 17% (16⅔% rounded). The flap of valve 31*a* is set to the right, and the flap of valve 31*b* is set to the left. The gas flow from each dedicated EGR cylinder 201*d* is still presented with a relatively unrestricted path.

FIG. 6 illustrates valve 245 system set to route all EGR exhaust gas to the main exhaust line (via by-pass line 271), resulting in 0% EGR. Both valve flaps are set to the right.

Although the flow path from Cylinder 3 is somewhat tortuous, a 0% EGR state is only used in very low load conditions when the gas flowrate is small. Thus, any flow restriction caused by the flow path would be minimal.

Valve system 245 may be easily implemented as an integrated cast component. This cast component would contain cross-over lines 41 and 42, and EGR input lines 43 and 44. Valves 31*a* and 31*b* and their actuators may be contained in or connected to the cast component at or near ports. The cast component would have two input ports for EGR, an output port to the main exhaust line, and an output port to the EGR loop.

An advantage of the dual valve system 245, particularly as a cast component, is that it is compact. In an engine bay, available space is usually already at a premium. It is therefore beneficial to minimize the size of any additional equipment.

Referring again to FIG. 2, EGR control unit 250 has appropriate hardware and programming for implementing the above-described EGR rate control. Control unit 250 receives input data, such as data representing engine load and cold start conditions. It uses this input data to determine the desired EGR rate for the current engine operating conditions. Based on this determination, it generates control signals for actuators 32*a* and 32*b*.

Figure 7:
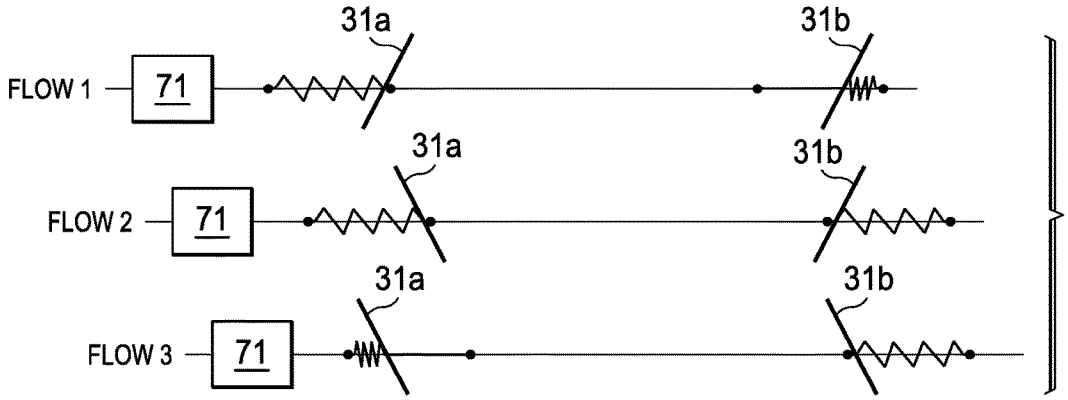
FIG. 7 illustrates how the dual valve system may be implemented with a single actuator for both valves.

FIG. 7 illustrates how the valves 31*a* and 31*b* may be driven with a single three-position actuator 71. The valve system 245 is the same as that described above. However, valves 31*a* and 31*b* are simultaneously actuated by a single actuator 71, which connects the valves with a linkage mechanism. Actuator 71 may have a spring-loaded "lost motion" mechanism, and the springs sized to prevent valve opening at undesired times due to gas pressure. The valves 31*a* and 31*b* are opened or closed as described above to achieve the flow paths for a 33%, 17% or 0% EGR rate.

What is claimed is:

1. An exhaust gas recirculation system for an internal combustion engine, the internal combustion engine having a high pressure EGR loop and a main exhaust line, comprising:

a first dedicated EGR cylinder;

a second dedicated EGR cylinder;

wherein the first dedicated EGR cylinder and the second dedicated EGR cylinder are the only cylinders of the internal combustion engine that provide recirculated exhaust to the internal combustion engine;

a dual valve system comprising:

a housing for containing the dual valve system, wherein the housing has a first input port for receiving exhaust from the first dedicated EGR cylinder, a second input port for receiving exhaust from the second dedicated EGR cylinder, an exhaust outlet to the main exhaust line, and an EGR outlet to the high pressure EGR loop;

wherein the housing only receives exhaust from the first dedicated EGR cylinder and the second dedicated EGR cylinder;

a first EGR input connection line;

a second EGR input connection line;

a first three-way valve having one input from the first EGR input connection line and two outputs;

a second three-way valve having one input from the second EGR input connection line and two outputs;

a first internal cross-flow line providing fluid flow from one of the two outputs of the first three-way valve to the EGR outlet;

a second internal cross-flow line providing fluid flow from one of the two outputs of the second three-way valve to a point on the first EGR input connection line upstream of the first three-way valve;

wherein the first three-way valve is operable to direct exhaust from the first EGR input connection line to either the exhaust outlet or to the first internal cross-flow line; and wherein the second three-way valve is operable to direct exhaust from the second EGR input connection line to either the second internal cross-flow line or to the EGR outlet.

2. The exhaust gas recirculation system of claim 1, wherein the high pressure EGR loop has a bypass line to the main exhaust line and wherein the exhaust outlet is connected to the main exhaust line via the bypass line.

3. The exhaust gas recirculation system of claim 1, wherein the first three-way valve and the second three-way valve have separate actuators.

4. The exhaust gas recirculation system of claim 1, wherein the first three-way valve and the second three-way valve are driven by the same actuator.

5. The exhaust gas recirculation system of claim 1, wherein the first three-way valve and the second three-way valve are vacuum-actuated valves.

6. The exhaust gas recirculation system of claim 1, wherein the internal combustion engine is installed in an automotive vehicle, and the first three-way valve and the second three-way valve are driven by a vacuum actuator that drives other mechanisms of the automotive vehicle.

7. The exhaust gas recirculation system of claim 1, wherein the first three-way valve and the second three-way valve are flap-type valves.

8. The exhaust gas recirculation system of claim 1, wherein the first three-way valve and the second three-way valve are driven by an electronic actuator.

9. The exhaust gas recirculation system of claim 1, wherein the first three-way valve and the second three-way valve are rotary or spool valves.

10. The exhaust gas recirculation system of claim 1, wherein the first EGR input connection line, the second EGR input connection line, the first internal cross-flow line, and the second internal cross-flow line are formed as a cast component.

11. A method of using an exhaust gas recirculation (EGR) system for an internal combustion engine, the internal combustion engine having a number of cylinders, a high pressure EGR loop and a main exhaust line, the method comprising:

operating two of the cylinders as dedicated EGR cylinders such that all exhaust from the dedicated EGR cylinders is routed to the high pressure EGR loop or to the main exhaust line and all exhaust from the remaining cylinders is routed to only the main exhaust line;

receiving exhaust from a first one of the dedicated EGR cylinders into a first input port of a housing of a dual valve system;

receiving exhaust from a second one of the dedicated EGR cylinders into a second port of the housing of the dual valve system;

wherein the dual valve system comprises: the housing for containing the dual valve system, the housing further having an exhaust outlet to the main exhaust line and an EGR outlet to the high pressure EGR loop; a first EGR input connection line; a second EGR input connection line; a first three-way valve having one input from the first EGR input connection line and two outputs; a second three-way valve having one input from the second EGR input connection line and two outputs; a first internal cross-flow line providing fluid flow from one of the two outputs of the first three-way valve to the EGR outlet; and a second internal cross-flow line providing fluid flow from one of the two outputs of the second three-way valve to a point on the first EGR input connection line downstream of the first three-way valve;

operating the first three-way valve to direct exhaust from the first EGR input connection line to either the exhaust outlet or to the first internal cross-flow line; and operating the second three-way valve to direct exhaust from the second EGR input connection line to either the second internal cross-flow line or to the EGR outlet.

12. The method of claim 11, wherein the high pressure EGR loop has a bypass line to the main exhaust line and wherein the exhaust outlet is connected to the main exhaust line via the bypass line.

13. The method of claim 11, wherein the first three-way valve and the second three-way valve are driven by separate actuators.

14. The method of claim 11, wherein the first three-way valve and the second three-way valve are driven by the same actuator.

15. The method of claim 11, wherein at least one of the first three-way valve or the second three-way valve is vacuum-actuated.

16. The method of claim 11, wherein the internal combustion engine is installed in an automotive vehicle, and the first three-way valve and the second three-way valve are driven by a vacuum actuator that drives other mechanisms of the automotive vehicle.

17. The method of claim 11, wherein at least one of the first three-way valve or the second three-way valve is a flap-type valve.

18. The method of claim 11, wherein at least one of the first three-way valve or the second three-way valve is driven by an electronic actuator.

19. The method of claim 11, wherein at least one of the first three-way valve or the second three-way valve is a rotary or spool valve.

* * * * *